United States Patent [19]

Pugh

[11] 4,408,657

[45] Oct. 11, 1983

[54] METHOD FOR TRANSPORTING LOW TEMPERATURE HEAT LONG DISTANCES

[76] Inventor: Paul F. Pugh, 4082 Sequoyah Rd., Oakland, Calif. 94605

[21] Appl. No.: 225,868

[22] Filed: Jan. 19, 1981

[51] Int. Cl.[3] ..... F28D 13/00

[52] U.S. Cl. ..... 165/1; 165/45; 165/104.34; 138/112

[58] Field of Search ..... 165/45, 1, 104.34; 62/260; 405/154; 138/111, 112, 114; 48/190

[56] References Cited

U.S. PATENT DOCUMENTS

| | | | |
|---|---|---|---|
| 1,663,878 | 3/1928 | Emanueli | 138/111 X |
| 1,717,005 | 6/1929 | Carrier | 62/260 X |
| 1,904,686 | 4/1933 | Humphreys | 62/260 X |
| 2,077,315 | 4/1937 | Ewing et al. | 62/260 X |
| 3,424,232 | 1/1969 | Garrett | 165/45 |
| 3,791,443 | 2/1974 | Burt et al. | 165/45 |
| 3,990,502 | 11/1976 | Best | 165/45 X |
| 4,014,369 | 3/1977 | Kobres, Jr. | 138/114 X |
| 4,139,321 | 2/1979 | Werner | 405/154 |
| 4,323,113 | 4/1982 | Troyer | 165/45 |
| 4,336,415 | 6/1982 | Walling | 138/111 X |

*Primary Examiner*—William E. Tapolcai

[57] ABSTRACT

A new method for transporting low temperature heat long distances consists of a system of high pressure air with a high specific heat in a low heat loss and low cost non-metallic heat pipe that is coilable for plowing into the earth. The hot air is used for space heating or for heating hot water heating systems or for process heat.

The purpose of the invention is to reduce cost and save fossil fuel. High pressure air as opposed to hot water or steam for moving heat energy ecologically sound. Remote geothermal hot water wells can be economically moved several miles or hundreds of miles to communities for space heating. Remote waste heat sources at electrical generating plants and other fossil fuel burning heat system can be transported long distances for building use.

6 Claims, 3 Drawing Figures

METHOD FOR TRANSPORTING LOW TEMPERATURE HEAT LONG DISTANCES

BACKGROUND OF THE INVENTION

The prior art for transporting heat energy relates to water systems which are used in Europe. Both rigid and coilable pipe systems have been used. Water has always been consider more efficient than air for transporting heat energy because of the high specific heat of water.

The new method is a system whereas the air is high pressure air to permit a long distance of transmission and a controlled humidity which increases the specific heat of the air and makes it more efficient.

The use of air permits one way transfer of the fluid from the source with no corrosion.

Most space heating is by air which permits using system for existing building space heating systems.

The cost of fossil fuel has increased 5 to 10 times in the past 10 years, which now makes remote waste and renewable heat sources feasible if a low cost method is available for transporting the heat energy.

This invention was approached on the basis of low cost materials and low cost methods. Non-metallic coilable pipes in sizes 3" and smaller have been used by the natural gas industry for over 15 years directly buried in city streets. These pipes have burst strengths of 500 psig at room temperature. To operate at high pressures and high temperatures at a low cost required conception of a two pressure pipe. The inner pipe or pipes are under high pressure and heat, but the outer pipe is at a lower pressure. The effect of the outer pressure on the inner pipes is to reduce the pressure on the inner pipe walls. Smaller inner pipes have a higher strength per unit cost, than big pipes.

The background of the invention was the recognition of a need and applying a technical solution.

SUMMARY OF THE INVENTION

This invention relates to energy conservation and the utilization of re-newable energy sources and remote waste heat sources. The high cost of transporting heat energy long distances restricts the use of these remote heat energy sources.

This invention overcomes the high cost of present systems and eliminates the ecological problems of transporting corrosive water from geothermal wells. New methods are invented for a system which uses compressed air and plowed in the earth heat pipe for transporting low temperature heat energy long distances.

The system consists of heat exchanger to transfer the geothermal or waste heat into heat air. The air is supplied by a an air compressor and humidifier which puts out a high pressure from 100 to 400 psig with a humidity to give a specific heat of 0.1 to 0.5 depending on the capacity and distance.

The high pressure air is pumped through a heat pipe plowed into earth for low installed cost and the earth used for a thermal barrier. The route of the pipe can be selected for a soil with high thermal reistivity. The air compressor does the pumping. One or more heat exchangers and air compressors would be used for redundancy for high reliability and for shutting down one at a time for maintenance.

The low cost heat pipe uses inner and outer non-metallic pipes of various materials such as polyethlene, polyprolylene, or poluybutene which can be coiled on reels in long lengths in sizes up to 3". They are easily joined by butt-fusion and other mechanical methods to hold pressure. Each has a temperature, pressure rating and cost which makes any one more suitable for a particular project.

The inner pipe or pipes contain the high pressure and are surround-by an outer high pressure which reduces the stress on the inner pipe which has a higher temperature.

The inner pipe or pipes are contained in multiple layers of dry paper in a dry air to prevent condensation. The dry paper and dry gas provides a thermal barrier. Multiple pipes inside act as a thermal barrier by mutual heating.

The outer pipe is at lower pressure, but is pressurized to reduce the stress on the inner pipe and to prevent the entrance of moisture. The outer pipe is the same material as the inner pipe or a different material based on temperature, pressure, and economics relationship. The outer pipe must be tough enough to take plow-in without damage.

The outer pipe may be operated under a vacuum which will increase the thermal barrier of the space from the inner to the outer pipes. Pressure will prevent moisture from entering if a leak occurs and it will limit the pressure to which the inner pipe can be operated. Vacuum systems may be more economical on shorter, high capacity lines.

The outer pipes would operate at a pressure from 1 to 250 psig depending upon the internal pipe pressure or air pressure.

Multiple smaller inner pipes may be more economical than one large inner pipe.

Air pressure systems have little static pressure and are ideal for hilly terrain. Water systems have a static pressure.

The non-metallic pipes are smooth with a low friction factor, they are easy to splice and repair and maintain. They have no corrosion or scaling problems.

The efficiency of an high pressure system, economically selected for a 7 mile pipe with a capacity of 9.5 million BTU per hour was 91% with an operating cost 30¢ to $1 for million BTU of energy depending on the cost of electrical energy to operate the air compressor and pumps for the geothermal water. The present cost of fossil fuel for space heating is $3 to $5 per million BTU and systems are only 60 to 80% efficient.

BRIEF DISCRIPTION OF THE DRAWINGS

FIG. 1 is a block diagram of the method for connecting and showing the parts of the system. A thermal energy source such as geothermal hot water is passed through a heat exchanger which transfers the thermal energy to a high pressure air which has a high specific heat which is controlled by the humidity of the air.

The high pressure air is provided by an air compressor and humidifier. The high pressure air is pumped by the air compressor through an underground heat pipe for a long distance to buildings where the thermal energy is used for space heating directly or through a heat exchanger to a hot water heating system.

FIG. 2 is a section view of a new heat pipe which consists of four small non-metallic pipes. The four pipes are wrapped in a group by dry paper tapes with a moisture content of less than 6% by weight.

The core of the pipes and paper tapes are placed in an outer non-metallic pipe. The inner pipes are pressurized at a high air pressure of 100 to 400 psig with a specific heat of 0.1 to 0.5 BTU per degree Fahrenheit per cubic feet. The outer pipe contains dry air from 10 to 250 psig to prevent condensation.

FIG. 3 is a section of a group of cables plowed into the earth. Each heat pipe may be coiled on to a reel in long lengths for direct burial in the earth. The earth and the group of pipes acts as a thermal barrier to hold the heat in the inner pipes of each individual pipe.

DETAILED DESCRIPTION OF THE DRAWINGS

Figure 1:
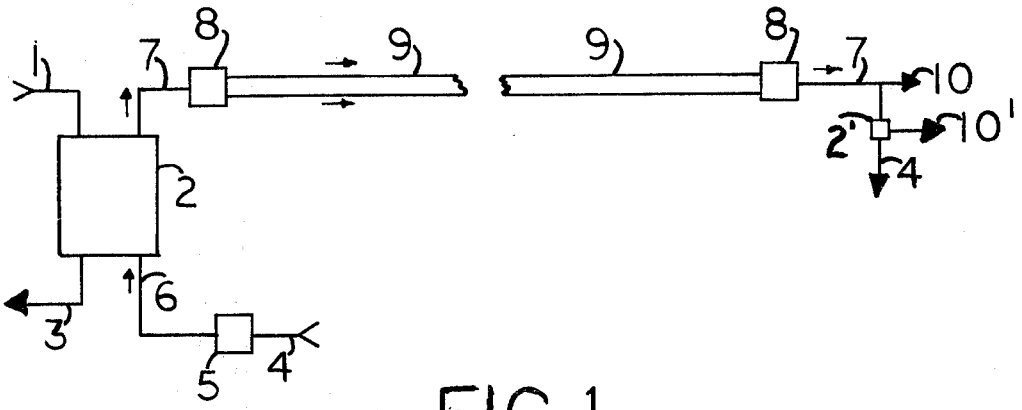

FIG. 1 is block diagram of the system. Geothermal hot water 1 is passed through heat exchanger 2 and is returned to earth 3. Air 4 is taken taken from the surrounding atmosphere and compressed to a high pressure with a controlled humidity by a compressor-humidifer 5.

A short pipe connection 6 connects heat exchanger 2 and air compressor-humidifier 5. Pipe 7 is a connecting pipe from heat exchanger 5. Junction box 8 connects heat pipes 9 to connecting pipe 7. At far end of heat pipes, another junction box 8 and connecting pipe 7 are used to connect to building space heating system 10 or heat exchanger 2. Hot water heating system 10' is connected to heat exchanger 2'. Hot air passing through heat exchanger 2' is returned to atmosphere 4.

Figure 2:
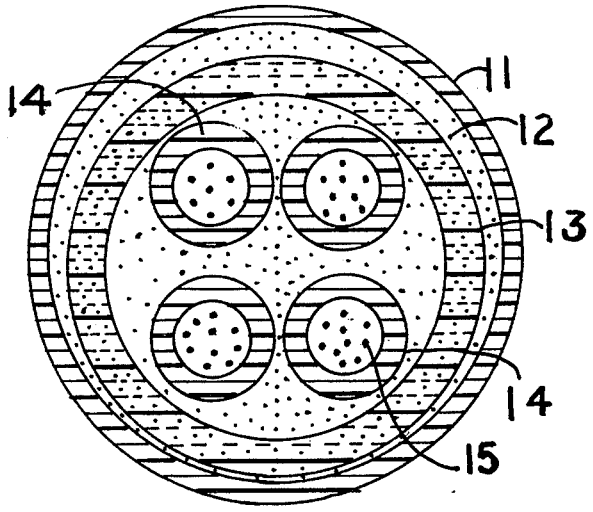

FIG. 2 is a section view of the heat pipe. An outer non-metallic pipe 11 is pressurized by dry air 12 from 10 to 250 psig.

Dry paper tapes 13 with less than 6% moisture content by weight are wrapped around non-metallic pipes 14. The dry air 12 which saturates the dry paper tapes 13 and the space between pipes 14 and 11 has a dew point to prevent condensation.

High pressure air 15 is contained by pipes 14. The specific heat of air 15 is from 0.1 to 0.5 by controlled humidity. The pressure of air 15 is from 100 to 400 psig, based on the heating load and distance. The pressure of dry air 12 is selected to counter the internal pressure pipes 14 which permits a higher operating pressure for the heated air 15.

Non-metallic pipes 11 and 14 can be rigid or coilable. The heat cable 9 shown in FIG. 1 can be factory assembled or field assembled. Very large pipes would be field assembled in whole or part.

Non-metallic pipes 11 and 14 would be made from polyethylene, polypropylene, or polybutene based on cost, operating temperature, operating pressure, water vapor diffusion, mechanical properties for installation, and environmental considerations.

Figure 3:
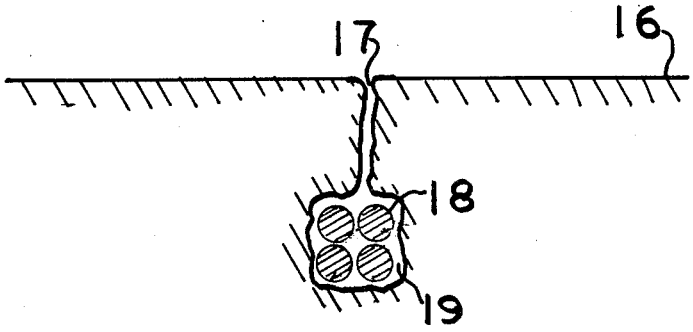

FIG. 3 is a section of earth 16 with a slot 17 in earth 16. At the bottom of slot 17 are shown pipes 18 which were laid in opening 19. Earth opening 19 is an air pocket which provides a thermal barrier to keep heat in heat pipes 18. A group of heat pipes 18 adds to the thermal barrier of each pipe 18 and prevents the loss of heat.

The new method for transporting low temperature heat energy long distances is a system invention. It is within the contemplated scope of this invention that numerous changes and variations can be made in the embodiments and techniques disclosed herein without departing from the intended scope of the invention. The pipe materials may be natural or synthetic. The spacer material may be natural or synthetic tape or pulp materials or a combination of both. The pressures of the inner outer pipes may change based on pipe material used. The specific heat of the hot air may vary up or down based on economics. The driness of the paper tapes or insulating barrier and dry air between the inner and outer pipes may be higher or lower based on economics. A drier barrier is more expensive to obtain, but will reduce the heat loss. A vacuum system in place of a dry air over the inner pipes might be used.

I claim:

1. A method for transporting low temperature thermal energy underground from distant geothermal, solar, or waste heat processing plants by means of a system comprising;

an air compressor which compresses ambient air to 100 to 400 pounds per square inch gauge pressure with a controlled specific heat of said air from 0.1 to 0.5;

said compressed air passing through a heat exchanger which raises the temperature of said air;

said air continuing through one or more pressurizable non-metallic enclosures to a utilization point;

said enclosure being surrounded by an outer dry insulating spacer filled with dry compressed air, and a pressurizeable outer non-metallic enclosure; and said outer enclosure directly buried in the earth.

2. A method according to claim 1 except wherein said non-metallic enclosures are coilable high density polyethylene.

3. A method according to claim 1 except wherein said non-metallic enclosures are coilable polypropylene.

4. A method according to claim 1 except wherein said non-metallic enclosures are coilable polybutlyene.

5. A method according to claim 1 except wherein said spacer under said outer enclosure is in a vacuum.

6. A method according to claim 1 except wherein said spacer is dry paper.

* * * * *